United States Patent [19]

Sampson et al.

[11] Patent Number: 5,044,133

[45] **Date of Patent: * Sep. 3, 1991**

[54] SKYLIGHT CONSTRUCTION

[75] Inventors: Robert Sampson, Sanford; Sean Flanigan, Wells, both of Me.

[73] Assignee: Wasco Products, Inc., Sanford, Me.

[ * ] Notice: The portion of the term of this patent subsequent to May 29, 2007 has been disclaimed.

[21] Appl. No.: 446,077

[22] Filed: Dec. 5, 1989

Related U.S. Application Data

[63] Continuation of Ser. No. 283,797, Dec. 13, 1988, Pat. No. 4,926,594, and a continuation of Ser. No. 283,731, Dec. 13, 1988, Pat. No. 4,987,705, and a continuation of Ser. No. 283,803, Dec. 13, 1988, Pat. No. 4,928,455, and a continuation of Ser. No. 283,802, Dec. 13, 1988, Pat. No. 4,995,208.

[51] Int. Cl.[5] ..... E04B 7/18

[52] U.S. Cl. ..... 52/72; 52/200; 52/397; 52/403; 49/485

[58] Field of Search ..... 52/72, 200, 397, 403, 52/718, 788, 790, 822; 49/485, 495, 504, DIG. 1

[56] References Cited

U.S. PATENT DOCUMENTS

| | | | |
|---|---|---|---|
| Re. 32,539 | 11/1987 | Jentoft et al. . | |
| Re. 32,915 | 5/1989 | Jentoft et al. . | |
| 2,209,543 | 9/1973 | Melzer et al. . | |
| 2,317,428 | 4/1943 | Anderson . | |
| 2,661,229 | 12/1953 | Slaughter, Jr. . | |
| 2,842,073 | 7/1958 | Huston et al. . | |
| 2,853,330 | 9/1953 | Harry . | |
| 3,111,786 | 11/1963 | Wasserman . | |
| 3,139,702 | 7/1964 | Wasserman . | |
| 3,327,429 | 6/1967 | Slaughter . | |
| 3,646,717 | 3/1972 | Parker . | |
| 3,788,013 | 1/1974 | Veen, Jr. . | |
| 3,996,844 | 12/1976 | Leurent . | |
| 4,068,417 | 1/1978 | Anghinetti et al. . | |
| 4,073,097 | 2/1978 | Jentoft et al. . | |
| 4,104,834 | 8/1978 | Anghinetti et al. . | |
| 4,189,877 | 2/1980 | Jentoft et al. . | |
| 4,208,840 | 6/1980 | Jentoft et al. . | |
| 4,388,784 | 6/1983 | Jentoft et al. . | |
| 4,409,767 | 10/1983 | Jentoft et al. | 52/200 |
| 4,428,169 | 1/1984 | Tsakiris . | |
| 4,439,962 | 4/1984 | Jentoft et al. . | |
| 4,449,340 | 5/1984 | Jentoft et al. . | |
| 4,455,798 | 6/1984 | Tsakiris . | |
| 4,455,799 | 6/1984 | Jentoft et al. . | |
| 4,466,221 | 8/1984 | Couture . | |
| 4,468,899 | 9/1984 | Miller | 52/788 X |
| 4,473,979 | 10/1984 | Bruhm . | |
| 4,481,735 | 11/1984 | Jentoft . | |
| 4,514,943 | 5/1985 | Jentoft et al. | 52/200 |
| 4,527,368 | 7/1985 | Jentoft | 52/200 |
| 4,570,393 | 2/1986 | Minter | 49/485 X |
| 4,570,394 | 2/1986 | Jentoft | 52/200 |
| 4,589,238 | 5/1986 | Sampson et al. | 52/200 |
| 4,594,821 | 6/1986 | Bechtold et al. | 52/200 X |
| 4,702,049 | 10/1987 | Sampson et al. . | |
| 4,703,592 | 11/1987 | Sampson et al. | 52/200 |
| 4,726,156 | 2/1988 | Cousino | 52/72 |
| 4,750,302 | 6/1988 | Bechtold . | |
| 4,757,655 | 7/1988 | Jentoft et al. | 52/200 |
| 4,776,141 | 10/1988 | Powell . | |
| 4,862,657 | 9/1989 | Jentoft et al. . | |
| 4,896,468 | 1/1990 | Sampson et al. . | |

FOREIGN PATENT DOCUMENTS

| | | | |
|---|---|---|---|
| 7336747 | 2/1975 | Fed. Rep. of Germany | 52/200 |

*Primary Examiner*—John E. Murtagh
*Assistant Examiner*—Deborah McGann Ripley
*Attorney, Agent, or Firm*—Wolf, Greenfield & Sacks

[57] ABSTRACT

A skylight that may have a domed-type or flat-type glazing and which is adapted to fit within the opening of a roof or the like. The skylight includes a peripheral curb frame that may include a base frame and an operating leaf frame. A retainer is used for securing the skylight cover over the curb frame. The curb frame is preferably constructed of a rigid plastic material having high temperature resistant properties. A glazing cushioning member is disposed between the retainer and the curb frame for providing positioning and cushioning regarding the edge of the glazing. The glazing cushioning member also receives a securing bolt and is dimensioned to control the tightening of the retainer against the glazing. A sealing gasket is provided integral with the frame and, in one embodiment, seals between frame sections, and in another embodiment, seals with the skylight glazing.

11 Claims, 8 Drawing Sheets

34
36
28
22
56
25
14
17
52
50
51
18
44
16
20
60
14
2
2
118
17
56
40
11A
22
25
34
11
10
28
36

FIG. 7
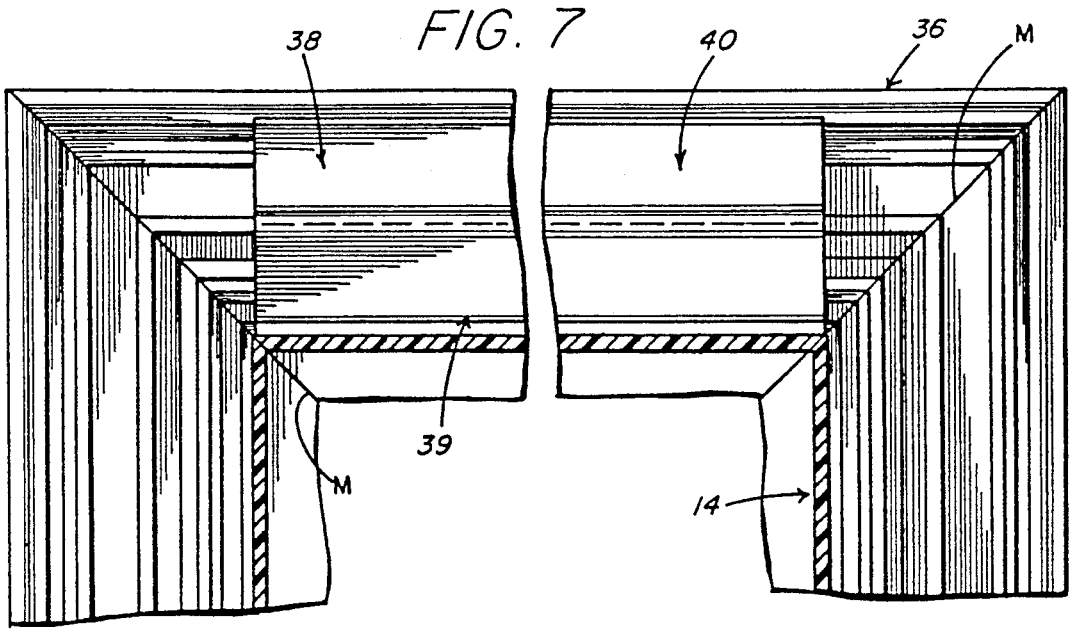
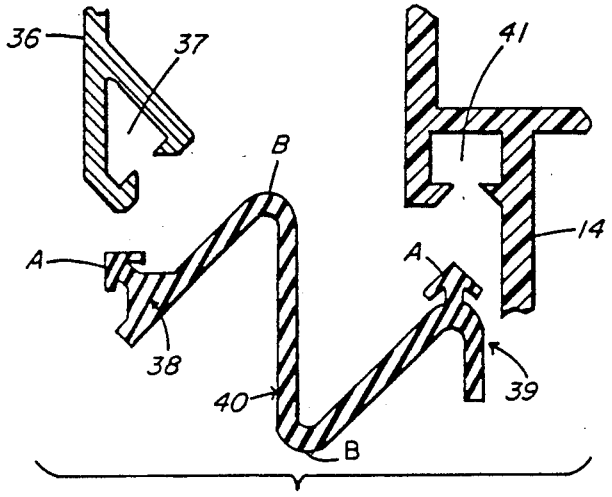
FIG. 8
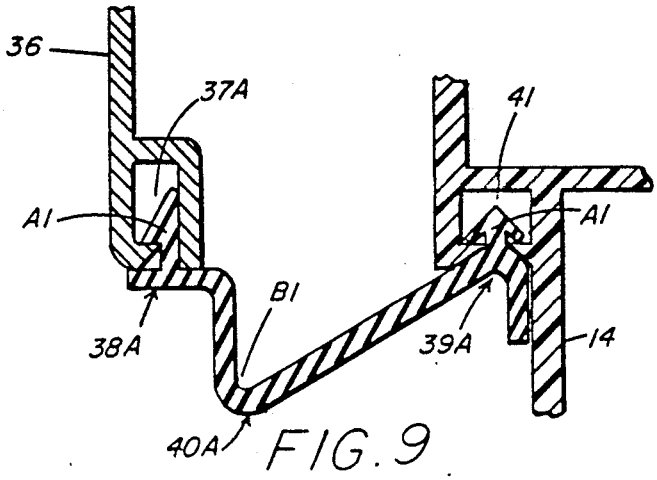
FIG. 9

SKYLIGHT CONSTRUCTION

RELATED APPLICATIONS

This application is considered to be a continuation application of the following earlier applications:

1. SKYLIGHT CONSTRUCTION, Ser. No. 07/283,797, filed on Dec. 13, 1988, now U.S. Pat. No. 4,926,594;
2. SKYLIGHT CONSTRUCTION, Ser. No. 07/283,731 filed on Dec. 13, 1988, now U.S. Pat. No. 4,987,705;
3. SKYLIGHT CONSTRUCTION, Ser. No. 07/283,803 filed on Dec. 13, 1988, now U.S. Pat. No. 4,928,455; and
4. SKYLIGHT CONSTRUCTION, Ser. No. 07/283,802 filed on Dec. 13, 1988, now U.S. Pat. No. 4,995,208.

BACKGROUND OF THE INVENTION

1. Field of the Invention

The present invention relates in general to an improved skylight construction and is concerned, more particularly, with an improved skylight construction preferably formed of a coextruded plastic material, thus adapting itself to simplified manufacture and having improved temperature resistant and weathering properties. Even more particularly, the present invention pertains to an improved gasket construction for a skylight, improvements in the skylight construction relating to the cushioning of the glazing, an improved gasket construction for the skylight which is particular characterized by improved weather and air tightness, and improved securing means for securing the skylight to a building.

2. Background Discussion

A skylight construction is shown, by way of example, in U.S. Pat. No. 4,449,340, granted May 22, 1984 and owned by the present assignee herein. This skylight construction is of plastic, including a frame that is comprised of a base frame and an operating leaf frame. A retainer that may be constructed of a lightweight metal material is typically employed for holding the glazing to the curb frame. Gasketing is typically provided between the glazing and the frame as well as between the frame components.

In connection with the gasketing that is typically provided in skylight constructions, and with reference to assignee's U.S. Pat. No. 4,449,340, it is noted that a tubular type gasket is employed between curb frame sections for providing an essentially single area sealing contact. In single piece curb frame sections, such as exemplified in the U.S. Pat. No. 4,455,799, it is typical to provide a cup-shaped gasket for sealing with the dome or glazing. However, such arrangements require the coextrusion of different configuration gaskets depending upon whether it is single piece or two piece curb frame application. Also, the gasketing generally provides only single area sealing contact.

It has been found that, particularly on steep-pitched roofs, and particularly under adverse rain conditions, that leakage may occur through the gasketing, particularly along the side of the skylight at the top side thereof on a slanted roof.

In U.S. Pat. No. 4,702,049, it is noted that a securing clip is employed for securing the skylight curb frame to the building. However, the securing clip, although engaging with the skylight curb frame, does not positively interlock therewith, and thus the securing clip may not be totally effective in the proper securing, as well as the positioning, of the skylight, particularly in proper orientation relative to the building opening. Accordingly, it is an object of the present invention to provide an improved securing clip for use with a skylight and, in particular, with the skylight curb frame, and furthermore, in particular, with a skylight curb frame made of a plastic material such as PVC.

Another object of the present invention is to provide an improved securing clip that is adapted to engage with a lower channel in the curb frame and that is furthermore adapted to provide positive interlocking between the securing clip and the curb frame.

Another object of the present invention to provide an improvement in skylight constructions in which cushioning is provided, essentially between the securing fastener associated with the retainer and the glazing or edge of the dome construction.

Another object of the present invention is to provide a new and improved skylight construction, particularly as it pertains to the use of a glazing cushioning member that provides a somewhat resilient surface for contact with the edge of the glazing and disposed intermediate the glazing and securing fastener or bolt.

A further object of the present invention is to provide a skylight construction as described in the foregoing objects, and in which the glazing cushioning member is constructed to receive the securing fastener therethrough for positioning thereof.

Still another object of the present invention is to provide an improved skylight construction in which the glazing cushioning member is constructed for snap fit engagement with the retainer.

Another object of the present invention is to provide an improved skylight construction, as set forth in the preceding objects, and wherein the glazing cushioning member furthermore functions to control the amount of tightening of the retainer against the glazing, so that the glazing is properly retained and held in place but not over-tightened.

Another object of the present invention to provide an improved gasket construction that is adapted to alleviate leakage problems that may occur through the usual gasketing employed in a skylight.

Another object of the present invention is to provide an improved skylight construction, and in particular a skylight construction having an improved gasket arrangement that assists in blockage and diversion of water, particularly at the top side of the skylight, and particularly under conditions of intense streams of water directed at the skylight, as might occur in a torrential downpour.

Still another object of the present invention is to provide an improved skylight construction having a water blocking and diverting gasket, also referred to herein as a header gasket, preferably coupled between the skylight retainer and curb frame, and preferably constructed for interlocking respectively therebetween.

Accordingly, it is an object of the present invention to provide an improved skylight construction, and in particular a skylight construction having an improved gasket system that is universally adaptable and useable in either single piece or multiple piece curb frame sections.

A further object of the present invention is to provide an improved sealing gasket for a skylight which is configured so as to provide proper sealing for both the application in which it is adapted to seal between curb frame sections as well as the application in which it is adapted to seal between the curb frame and covering or glazing.

Still another object of the present invention is to provide an improved skylight construction having an improved sealing gasket arrangement, and one which in particular provides multiple area sealing contact.

SUMMARY OF THE INVENTION

To accomplish the foregoing and other objects of this invention, there is provided a skylight construction adapted to be fitted into an opening in a building such as either a commercial building or a residential building. The skylight construction comprises a frame means that is of plastic construction, such as constructed of extruded PVC. The frame means or curb frame, extends about the opening and includes means for the securing thereof about the opening. The skylight construction also includes a translucent or transparent means covering the opening and extending at its edges to overlie the curb frame. The covering means may comprise one or more glazing panels, or may also be in the form of one or more plastic domes. A retainer extends about the periphery of the skylight for holding the glazing on the curb frame.

In the particular embodiment described herein, the curb frame is comprised of a base frame and an operating leaf frame overlying the base frame. However, the principles of the present invention may be employed in connection with either a single part or two-part curb frame. The curb frame is constructed of a rigid plastic profile having high temperature resistant properties and having integral therewith and coextruded therewith a flexible sealing flange.

In accordance with the present invention, associated with the skylight construction is a glazing cushioning member, that preferably snap-fits with the top leg of the retainer and has a passage in alignment with the hole through which the securing fastener for the retainer passes. The retainer has associated therewith a plurality of fasteners usually in the form of securing bolts and likewise also preferably has associated therewith a plurality of glazing cushioning members disposed about the periphery of the glazing. The glazing cushioning member includes a body adapted to be disposed between the top leg of the retainer and the top of the curb frame, and a somewhat resilient cushioning piece held by the body and disposed in facing relationship to the edge of the glazing. The height of the body of the glazing cushioning member is constructed so that when the securing bolt is tightened down, the body controls the spacing between the retainer and the curb frame so as to provide the proper pressure by the retainer on the glazing.

In accordance with the present invention, a header gasket is provided and may be disposed only at the top side of the skylight as installed on a slanted roof. The header gasket has a foldable center section and interlocking ends adapted to interlock, respectively, with the curb frame and retainer. The foldable section of the gasket enables the gasket to maintain its position in an operable skylight construction even when the skylight is opened and closed. The header gasket seals and assists in diverting water away from the skylight and prevents torrents of water from entering inside of the retainer and causing internal leakage at or about the skylight curb frame.

In accordance with the present invention, an improved sealing gasket is provided, and in particular a sealing gasket that is integral with and coextruded with the curb frame. The improved gasket construction provides for multiple are sealing contact. In one embodiment in accordance with the invention the gasket has a centrally disposed contact area as well as a pair of side disposed contact areas and is of generally tubular cross section. In one embodiment of the invention the gasket is adapted for providing a sealing between a base curb frame section and a overlying operative curb frame section. In accordance with another embodiment of the invention, the same gasket construction is useable for providing a sealing between the curb frame and the glazing.

In accordance with the present invention, an improved securing clip is provided that is adapted to provide a positive interlocking between the curb frame and the securing clip for proper positioning and securing of the skylight curb frame about the building opening. In this regard, the curb frame has a lower channel that receives the securing clip and in the lower channel there is defined in the curb frame a hook piece that engages with the channel in the securing clip so that once the securing clip is fully engaged in the curb frame channel then the securing clip is positively interlocked with the curb frame, thereby alleviating any positioning problems, and thereby ensuring that there will not be any slippage between the securing clip and the curb frame.

BRIEF DESCRIPTION OF THE DRAWINGS

Numerous other objects, features and advantages of the invention will now become apparent upon a reading of the following detailed description taken in conjunction with the accompanying drawings, in which:

FIG. 7 is a cross-sectional view taken along line 4—4 of FIG. 2;

FIG. 8 separately illustrates the detailed construction of the preferred form of header gasket in accordance with the present invention; and FIG. 9 illustrates in cross-sectional detail an alternate construction for the header gasket and alternate construction of the retainer for receiving the header gasket.

DETAILED DESCRIPTION

Figure 1:
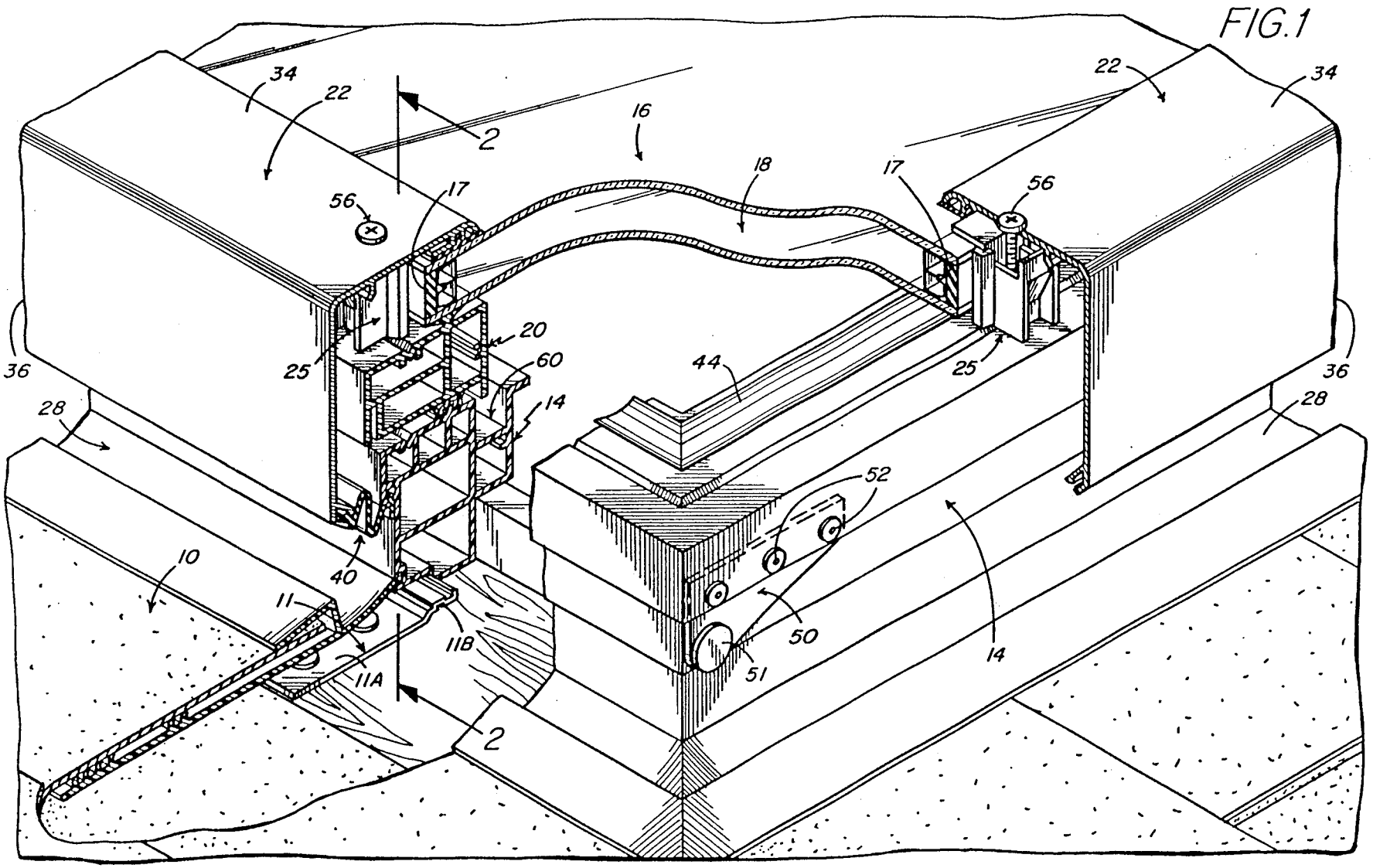
FIG. 1 is a perspective view, partially cut away, and illustrating a skylight construction in accordance with the present invention.
Figure 2:
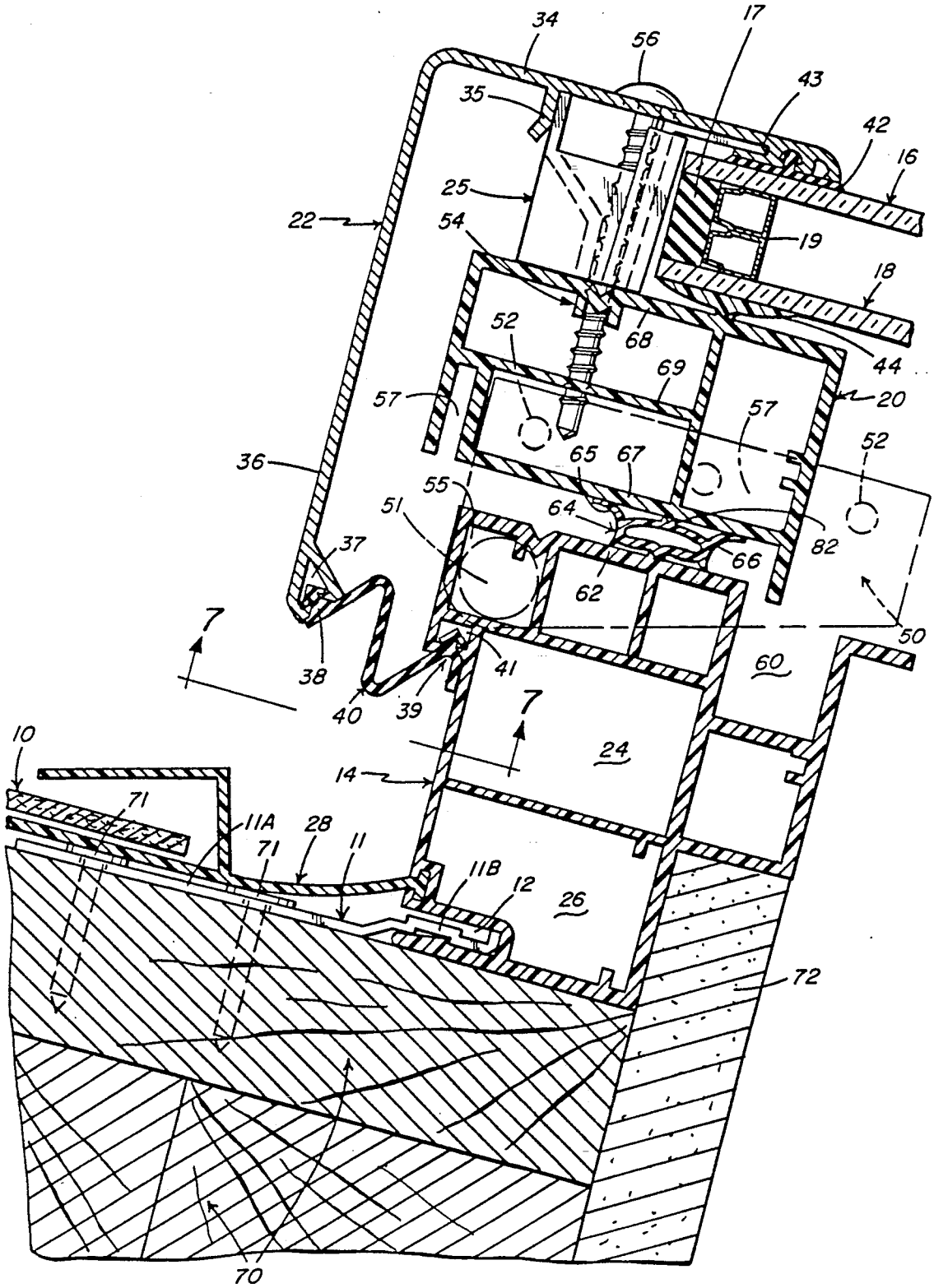
FIG. 2 is a cross-sectional view taken along line 2—2 of FIG. 1 and showing further cross-sectional details of the skylight construction.

Reference is now made to a skylight construction as illustrated in the cut-away perspective view of FIG. 1 and the cross-sectional view of FIG. 2. In the embodiment illustrated herein in FIGS. 1 and 2, the skylight is of a flat construction, having flat glazing panels. However, in alternate constructions, a domed type of skylight may also be employed. The skylight is adapted to span an opening which is generally of square or rectangular shape and the opening may be defined by upright walls or by headers within the roof construction.

The skylight described herein is characterized by improved energy performance; thermal air and weather tightness; simplicity of installation; good weathering properties; and enhanced durability.

The skylight construction shown herein includes a pair of glazing panels 16 and 18, a base frame 14, an operating leaf frame 20, and a retainer 22. The two frames 14 and 20 are constructed of a rigid PVC material and these frames are individually coextruded. The retainer 22 is preferably constructed of a lightweight metal material such as aluminum.

Each of the frames 14 and 20 is constructed by a coextrusion process in which a flexible gasket such a gasket 44 is coextruded with a rigid frame section. At the corner mitres, both the rigid and the flexible part of the frames are joined by a technique such as a heat platen sealing technique. This technique commonly joins the rigid frame sections at the corner mitres while at the same time joining the gaskets for providing a continuous seal about the entire skylight curb frame construction.

The base frame 14 may also be referred to as a fixed leaf, while the support frame 20 may also be referred to as the overlying operating leaf. The base frame 14 has internal compartments 24 and 26 and has associated therewith a peripheral sealing flange 28. As indicated, for example, in FIG. 2, the flange 28 interlocks with the base frame 14 and receives a piece of roofing such as the roofing shingle 10 illustrated in FIG. 2. Also refer to FIG. 1 for a clear showing of the manner in which the shingles 10 cooperatively interengage with the sealing flange 28. For further details on the construction and associated function of the sealing flange 28, refer to the assignee's U.S. Pat. No. 4,702,049, granted Oct. 27, 1987.

To secure the skylight, and in particular the base frame 14 thereof, in place on the roof, there are provided a plurality of securing clips 11, each having one end **11*a* for securing the clip to the roof construction and another end 11*b* received by the base frame 14 at the recess 12, as illustrated in FIG. 2. A series of these securing clips 11 may be disposed about all sides of the base frame 14. As illustrated in FIG. 2, the securing clip 11 at its end 11*a* is substantially flat and preferably has two holes for receiving roofing nails. The opposite end 11*b* of the securing clip 11 has a stepped construction to enable the securing clip to interlock in the recess 12 in the base frame 14**.

The skylight glazing plates 16 and 18 are supported over the support frame 20 by means of the retainer 22. The plates 16 and 18 are supported by a glazing frame 19. On the outer periphery of the frame 19 between the plates 16 and 18 there is a gasket 17. The gasket 17 may be of a premolded butyl material. As illustrated in FIG. 2, the frame 19 may be comprised of separate metal spacers with an outer seal comprising a chemically curable two-part polysulfide.

The lower glazing plate 18 rests upon a cup-shaped sealing gasket 44 which is coextruded with the support frame 20. In FIG. 2, the gasket 44 is shown in its compressed position. The operating leaf or support frame 20 also includes means defining a channel 54 for receiving a securing bolt 56. The channel 54 is preferably threaded to receive the bolt 56. There are actually a plurality of these securing bolts or screws that are employed for securing the retainer 22 over the glazing plates 16 and 18. Two of the securing bolts 56 are shown in the perspective view of FIG. 1, each having associated therewith a cushioning member 25. The securing bolt 56 actually passes through the glazing cushioning member 25, forming a cushioning for the edges of the glazing plates to prevent damage thereto, as well as to facilitate positioning thereof.

The retainer 22 has a top leg 34 and a side leg 36. The retainer 22 is generally of L-shaped construction. At the bottom end of leg 36 there is provided a pair of walls defining an interlocking channel 37 for receiving one end 38 of the header gasket 40. The other end 39 of the header gasket 40 is received within an interlocking channel 41 formed in the base frame 14. In FIG. 2 the header gasket 40 is shown in the closed position of the skylight with the header gasket thus in its more elongated form.

The top leg 34 of the retainer 22 is also adapted to receive a gasket, illustrated in FIG. 2 as the relatively flat gasket 42 that is interlocked with the very free end of the leg 34. The gasket 42 may be constructed of a premolded butyl material and is adapted to engage with and securely hold the top of the glazing plates, contacting the plate 16 as illustrated in FIG. 2. The top leg 34 also has a depending wall 35 for engagement by the glazing cushioning member 25. The leg 34 also includes a slot 43 for receiving a leg of the glass cushion member 25.

As indicated previously, the particular skylight construction depicted herein is in the form of a two-part curb frame with a base frame added overlying the operating frame. For the purpose of opening the operating frame, there are provided hinges 50, one on either side of the skylight. The cut-away perspective view of FIG. 1 shows the hinge 50 having associated therewith a pivot pin 51 and rivets 52. FIG. 2 also shows, in dotted outline, the hinge 50 and the placement of the pop rivets at 52. FIG. 2 also shows, in dotted outline, the pivot pin 51. The pin 51 is adapted to be retained in the channel 55 of the base frame 14. The overlying leaf frame 20 has a peripherally disposed channel 57 and along the sides thereof, the hinge 50 is pop riveted to the frame 20 while the hinge 50 is maintained in this channel 57.

Regarding the base frame 14, as indicated previously, it includes compartments 24 and 26, recess 12 for receiving the securing clip 11, and channels for receiving the pivot pin 51 and the header gasket 40. The base frame 14 also is provided with a condensation gutter 60 and furthermore supports at its top wall 62 the gasket 64. The gasket 64 is constructed to provide multiple sealing points. The gasket 64 is generally of cylindrical construction but is provided with separately disposed ears such as the ears 65 and 66 illustrated in FIG. 2. FIG. 2 clearly illustrates the multiple sealing points of the gasket 64. It is also noted that multiple sealing points are provided not only at the wall 62 but also at the wall 67 of the overlying leaf frame 20. In FIG. 2 the gasket 64 is shown in partially compressed position and providing an effective watertight seal between the separate curb frame sections.

Reference has been made hereinbefore to the bolt 56 as it relates to securing the retainer to the curb frame. As noted in FIG. 2, the bolt 56 preferably passes not only through the threaded channel 54 in wall 68 of the support frame 20, but also through the wall 69. In other words, the securing bolt 56 actually penetrates two walls of the support frame 20. This adds further stability to the overall skylight construction, particularly as it relates to the retaining of the glazings.

FIG. 2 shows a part of the building construction, including building members 70, which may be of wood construction such as typical 2×4s or 2×6s. FIG. 2 shows the roofing nails 71 used through the securing clip 11 and driven into the members 70. There is also illustrated in FIG. 2 a gypsum board 72 associated with the base frame 14. This is a typical building construction that can be used and that is associated with the skylight.

Figure 3:
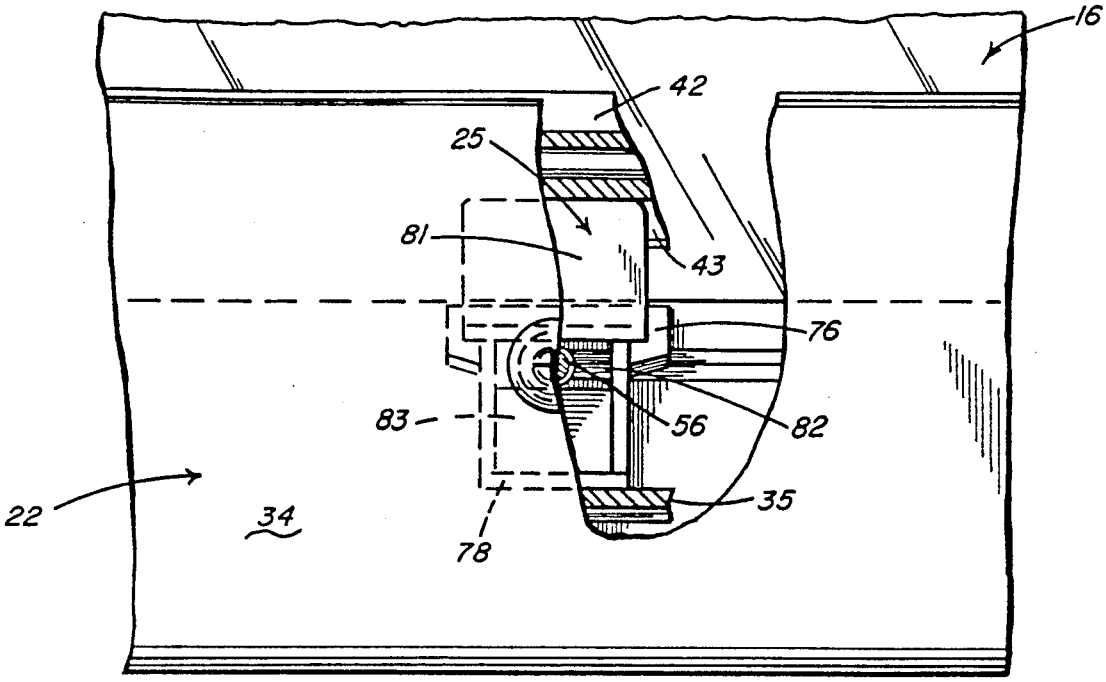
FIG. 3 is a fragmentary plan view of the skylight construction at a securing bolt and partially cut away to show further details of the glazing cushioning member.
Figure 4:
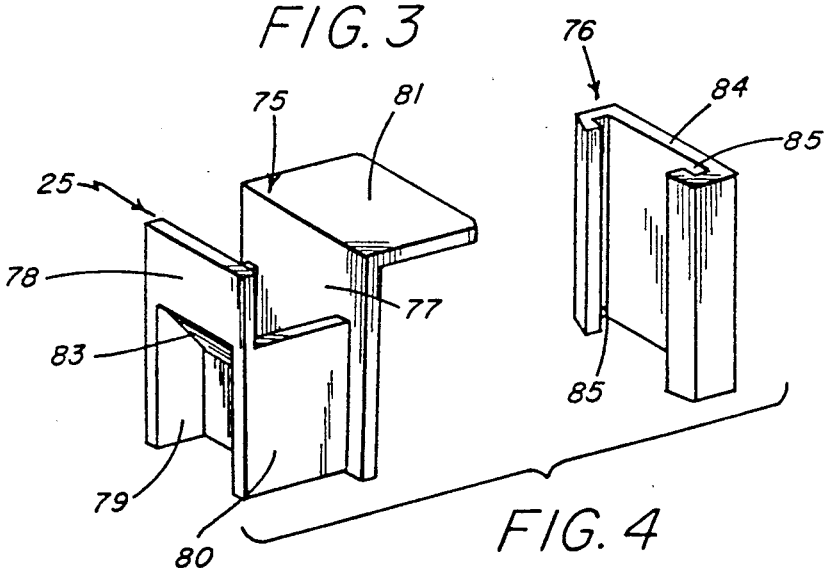
FIG. 4 is a perspective view showing the components of the glazing cushioning member.
Figure 5:
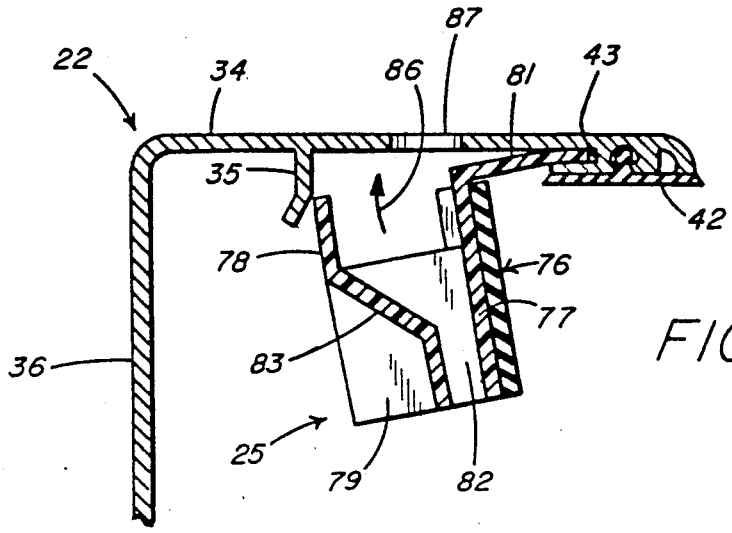
FIG. 5 is a cross-sectional view showing the manner in which the glazing cushioning member is snap-fitted into the retainer.

Reference is now made to FIGS. 3–5 for further details of the glazing cushioning member 25. In this regard, reference is also made to the cross-sectional view of FIG. 2 that shows the glazing cushioning member 25 as snap-fitted into place in the retainer 22. FIG. 2 clearly illustrates the positioning of the member 25 in close proximity to the glazing.

The glazing cushioning member 25 is comprised of a rigid plastic body 75 and a somewhat resilient cushioning piece 76. The body 75 has front and rear walls 77 and 78, side walls 79 and 80, and leg 81. The leg 81 is disposed at right angles to the wall 77. These various walls define a hollow passage 82 defined in part by the tapered wall 83. The tapered wall 83 assists in guidance of the securing bolt 56 into and through the passage 82. In this regard, the securing bolt 56 is shown in place, having passed through the passage 82 in the body 75. The cushioning piece 76 is comprised of a cushioning wall 84 and turned ends defining opposed channels 85. The cushioning piece 76 is adapted to slide onto the wall 77 with the opposite sides of the wall 77 engaging in the opposed channels 85. In this regard, FIG. 5 shows the cushioning piece 76 in place on the body 75.

FIG. 5 illustrates the action of the glazing cushioning member 25 snap-fitted by movement in the direction of the arrow 86. The wall 78 engages with the wall 35, which forms part of the retainer 22. Initially, the leg 81 of the body 75 is disposed in the slot 43 in the retainer. FIG. 5 illustrates the leg in place and the body now being snapped upwardly to engage with the retainer. The passage 82 is adapted to be disposed in alignment with a bolt hole 87 provided in the retainer top leg 34, for receipt of a securing bolt. Again, FIG. 2 clearly illustrates the placement of the securing bolt 56 as it relates to the body 75 and the passage 82 thereof.

FIG. 2 also illustrates one other function of the member 25. The height of the member 25 is made so that when the securing bolt 56 is tightened down the proper amount of pressure is applied by the retainer against the glazing. This prevents overtightening of the securing bolt and makes the installation of the glazing on the curb frame more foolproof.

The body 75 of the glazing cushioning member 25 is preferably constructed of a quite rigid PVC material. The cushioning piece 76, on the other hand, is made of a material that is at least partially resilient and that will provide some cushioning should the glazing panel shift and contact the piece 76. Without this cushioning effect, the glazing could easily contact the securing bolt and could cause damage to the glazing. The cushioning piece 76 may be secured to the body by a close tolerance fit or some small amount of adhesive may be applied therebetween.

In the preferred embodiment disclosed herein, it is noted that the securing fastener passes through the glazing cushioning member 25. In an alternate embodiment the securing fastener may be disposed adjacent to the glazing cushioning member in which case the fastener would not pass then through the opening therein. In this instance, the fastener which may be a securing bolt can be disposed say an inch or so away from the glazing cushioning member and is adapted to extend through the top wall of the retainer and into the curb frame.

In summary, the glazing cushioning member of the present invention provides a cushioning for the glazing. It also provides a stable support between the retainer and the curb frame and prevents twisting and turning of the retainer as it is being secured in place. The glazing cushioning member also provides, in the preferred embodiment, a guide for the securing fastener to provide positive and precise locating thereof. The glazing cushioning member also assists in providing proper weather tightness. The glazing cushioning member is constructed so as to control the proper tightening of the securing fastener so as to make the installation of the glazing on the curb frame more foolproof.

Figure 6:
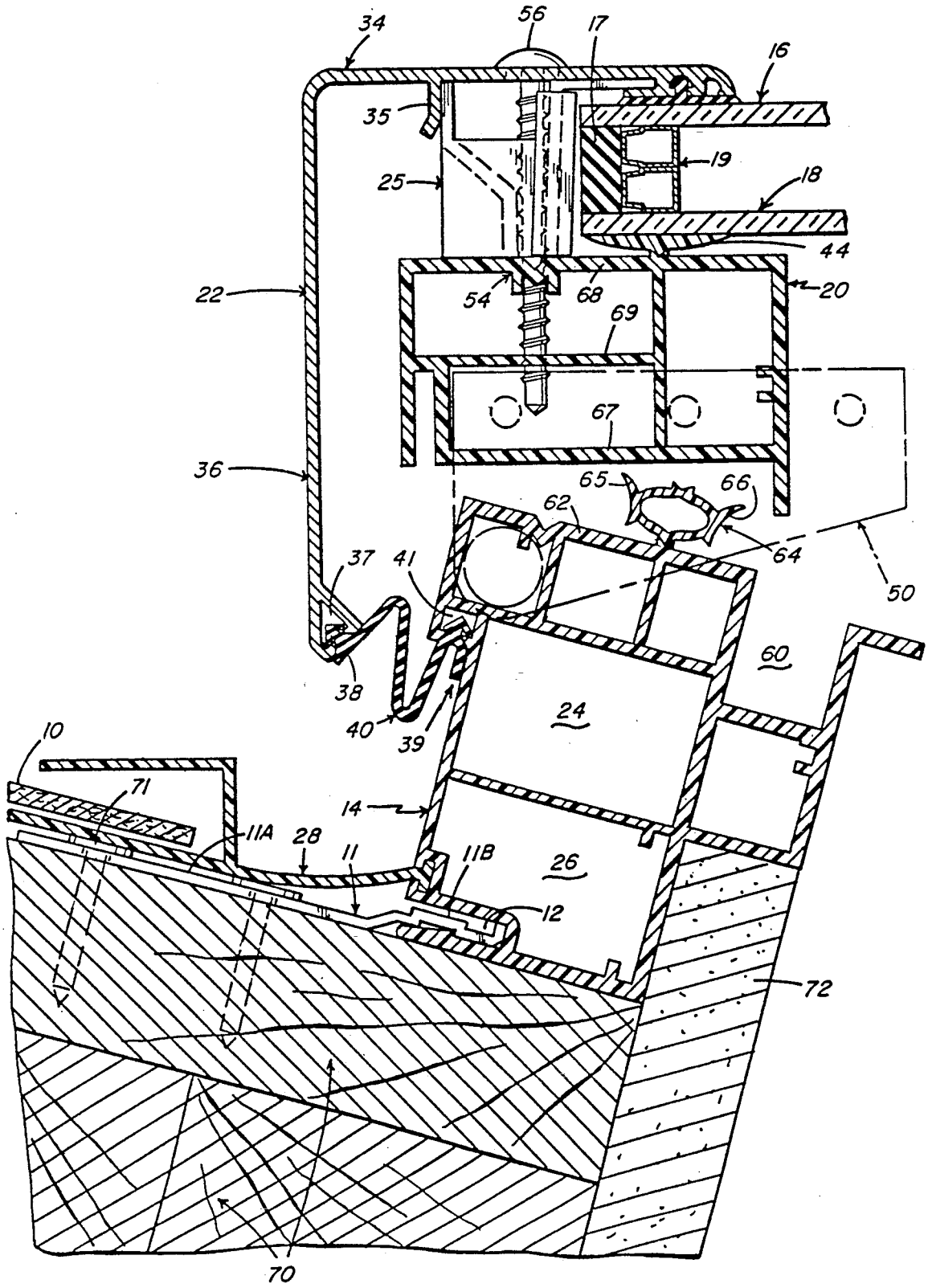
FIG. 6 is a cross-sectional view similar to the cross-sectional view of FIG. 2 but illustrating the skylight in an opened position.

Reference is now made to FIGS. 6–9 herein for further details of the header gasket construction as in accordance with the present invention. FIG. 6 is a cross-sectional view substantially the same as the cross-sectional view of FIG. 2 but illustrating the overlying operating leaf 20 pivoted to at least a partially open position. This view has been shown to illustrate the manner in which the header gasket 40 at its folded section can compress and essentially fold so as to readily accommodate movement between the base frame 14 and the overlying frame 20. Thus, the header gasket described herein is one that is constructed so that it is expandable in length.

FIG. 7 is a cross-sectional view taken along line 4—4 of FIG. 2. FIG. 7 illustrates the header gasket 40 as extending from mitre corner to mitre corner at mitres M. The gasket 40 is shown with squared ends, and that is the preferred form of construction.

FIGS. 8 and 9 are enlarged views of the header gasket 40 construction. FIG. 8 shows the same gasket as previously depicted in FIG. 6. FIG. 9 shows an alternate construction for the gasket. In FIG. 8, the end 38 as well as the end 39 has an arrow member A. The arrow A at end 38 is adapted to be accommodated in the interlocking recess 37. It is noted that the arrow A at end 39 is directed at a 45° angle. The arrow A is adapted for being accommodated in the interlocking recess 41 of the base frame 14. Between the ends 38 and 39 there is a folding section that includes two bends B.

The version of FIG. 9, instead of including two bends, includes only a single bend B1. The gasket 40A in FIG. 9 has, in addition to its center folding section, also ends 38A and 39A. Each of these ends has an arrow A1. The retainer 36 in this version has a recess 37A for receiving the arrow A1. Similarly, the base frame 14 has a recess 41 for receiving the arrow A1 in an interlocking position. It is noted in the version of FIG. 9 that both of the arrows A1 are directed in the same direction, while in the version of FIG. 8 the arrows A are disposed at 45° to each other.

In all of the embodiments of the header gasket described herein, it is noted that the gasket itself is made of a relatively flexible PVC material. The retaining recesses for the ends of the gasket are constructed in a rigid form. The interlocking arrows A and A1 are adapted to easily deflect when forced into their accommodating recesses. FIG. 8 shows the gasket separate from the recesses. FIG. 9 shows the gasket with the arrows being forced into the recesses and interlocked therewith.

Figure 10:
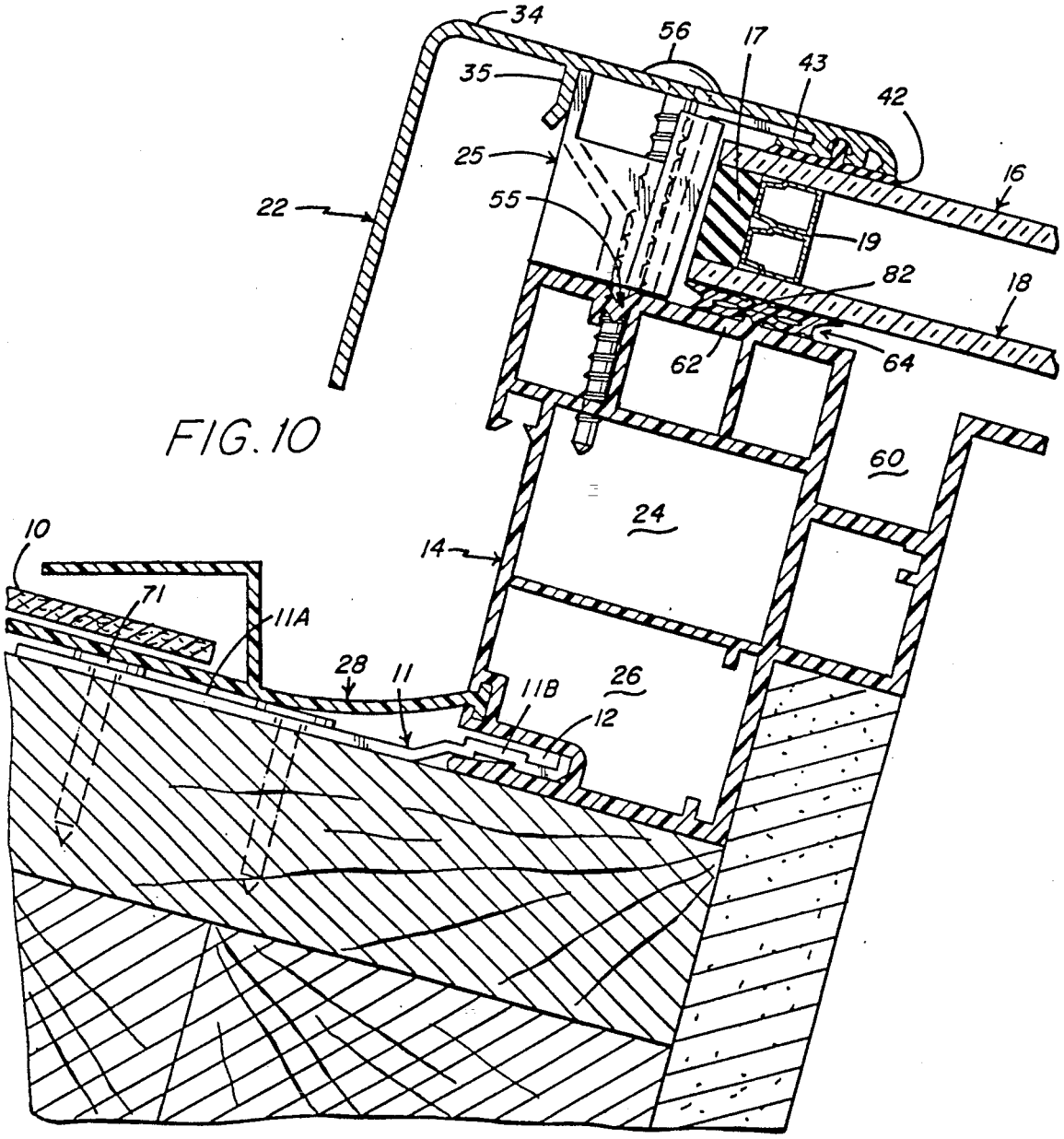
FIG. 10 is a cross-sectional view similar to that of FIG. 2 but for an alternate embodiment of the invention employing a single piece curb frame, basically comprised of a base curb frame, but having the same sealing gasket as in the earlier embodiment described, but for sealing between the curb frame and the glazing.

Reference is now made to FIGS. 6 and 10–12 herein for further details of the improved gasket construction as in accordance with the present invention. FIG. 6 is a cross-sectional view substantially the same as the cross-sectional view of FIG. 2, but illustrating the overlying operating leaf 20 pivoted to at least a partially open position. This view has been shown to illustrate the manner in which the gasket 64 reverts to its uncompressed position. In FIG. 2 the gasket 64 has been shown in its partially compressed position while in FIG. 6, once the operating leaf 20 opens, the gasket 64 reverts to its uncompressed position. Described hereinafter in FIG. 10 is the fully compressed position of the gasket 64.

Figure 11:
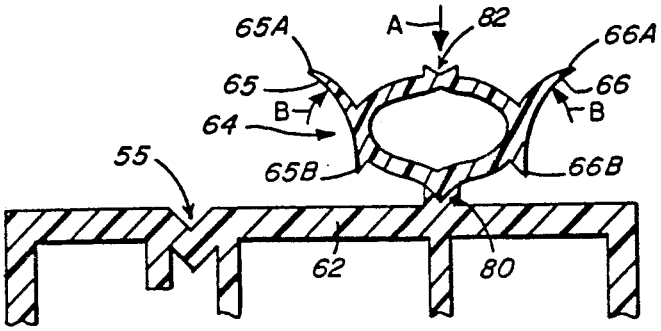
FIG. 11 is an enlarged fragmentary view of the improved gasket of the present invention.

FIG. 11 is an enlarged fragmentary view showing enlarged details of the multiple area sealing gasket 64. The gasket 64 is generally of cylindrical or tubular construction but is provided with separately disposed ears 65 and 66. Each of these ears, as illustrated in FIG. 5 have tips 65A and 65B, as well as 66A and 66B. The tips 65A and 66A, in the two-piece curb frame construction, provide contact with the wall 67 of leaf frame 20. The tips 65B and 66B provide contact with the wall 62 associated with the lower curb frame or base curb frame section 14.

As also noted in FIG. 11, the gasket 64 is coextruded and integral with the base curb frame section 14. The attachment is illustrated at 80. On the top side of the gasket, as viewed in FIG. 11, in addition to the tips 65A and 66A of the respective ears 65 and 66, there is also provided a relatively small sealing lip 82. The sealing lip 82 is disposed substantially midway between the ears 65 and 66.

Now, in the embodiment of the invention illustrated in FIG. 2, it is noted that the gasket 64 is in an essentially partially compressed position. When the gasket is adapted for use between curb frame sections, it is preferred that it be partially compressed and this provides proper gasket sealing. In the position of FIG. 2 it is noted that the ears 65 and 66 have been compressed to the point where the tips thereof contact the respective walls 62 and 67. In this connection the arcuate nature of each of the ears is helpful in providing proper sealing contact with the walls 62 and 67. FIG. 2 also illustrates the sealing lip 82 contacting the wall 67. FIG. 2 clearly illustrates the multiple sealing points or areas provided by this gasket construction.

As indicated previously, one of the advantages of the sealing gasket of the present invention is its universatility of use. FIG. 10 illustrates the further use of the gasket when it is associated with a base curb frame 14 for providing direct sealing between the curb frame and the glazing. In FIG. 10 the skylight construction is shown herein as including a pair of glazing panels 16 and 18, a base frame 14 and a retainer 22. The base frame 14 is constructed of a rigid PVC material and the retainer 22 is preferably constructed of a lightweight metal material such as aluminum.

Figure 12:
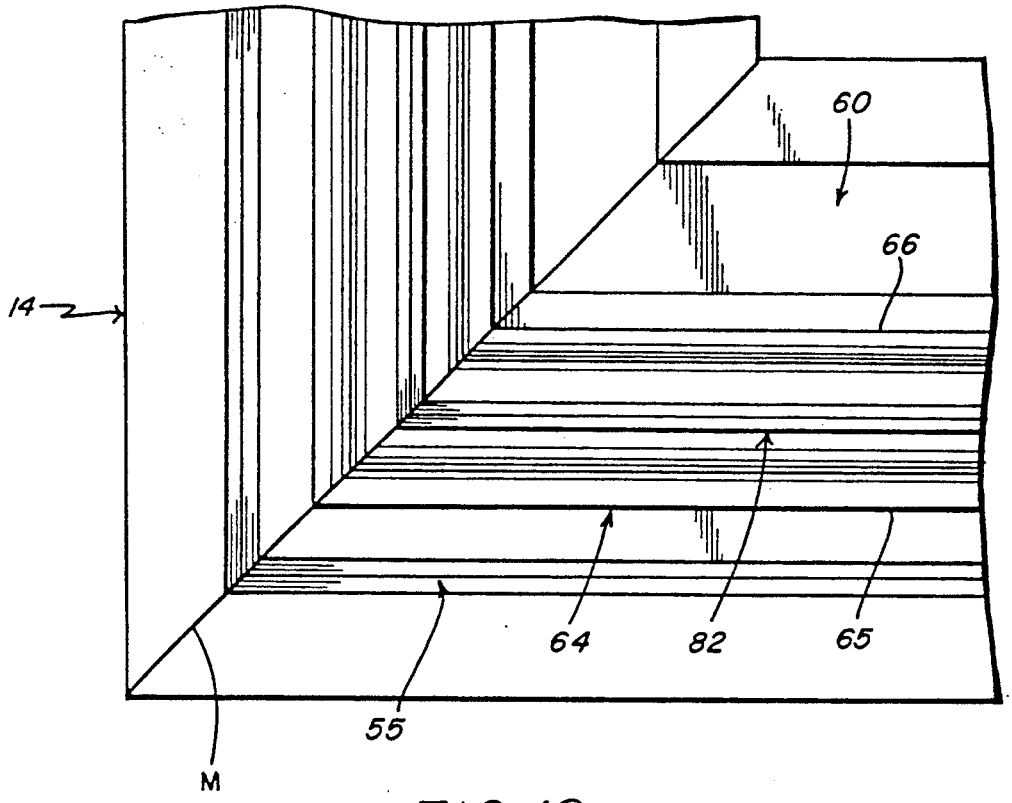
FIG. 12 is a fragmentary top plan view of a corner of the curb frame illustrating the joining of the curb frame and associated sealing gasket at the mitre.

The base frame 14 is constructed by a coextrusion process in which the gasket 64 is coextruded with the rigid frame section. At the corner mitres, as illustrated in FIG. 12 herein, both the rigid and the flexible part of the frame is joined by techniques such as a heat platen sealing technique. This technique commonly joins the rigid frame sections at the corner mitres while at the same time joining the gaskets for providing a continuous seal about the entire curb frame construction. FIG. 12 illustrates the base frame 14 with the sealing gasket 64 as joined at the curb frame mitre M.

The base frame 14 in FIG. 10 has internal compartments 24 and 26 and has associated therewith a peripheral sealing flange 28. The sealing flange 28 interlocks with the base frame 14 and receives a piece of roofing such as the roofing shingle 10. For further details on the construction and associated function of the sealing flange 28, refer to the assignee's U.S. Pat. No. 4,702,049 granted Oct. 27, 1987.

As in the embodiment of FIG. 2, in FIG. 10, to secure the skylight, and in particular the base frame 14, thereof, in place on the roof, there are provided a plurality of securing clips 11, each having one end 11*a* for securing the clip to the roof construction and another end 11*b* received by the base frame 14 at the recess 12. A series of these securing clips 11 may be disposed about all sides of the base frame 14. The securing clip 11 at its end 11*a* is substantially flat and preferably has two holes for receiving roofing nails. The opposite end 11*b* of the securing clip has a stepped construction to enable the securing clip to interlock in the recess 12 in the base frame 14.

The skylight glazing plates 16 and 18 are supported over the support frame 20 by means of the retainer 22. The plates 16 and 18 are supported by a glazing frame 19. On the outer periphery of the frame 19 between the plates 16 and 18 there is a gasket 17. The gasket 17 may be of a premolded butyl material. As illustrated in FIG. 10, the frame 19 may be comprised of separate metal spacers with a outer seal comprising a chemically curable two-part polysulfide.

The lower glazing plate 18 rests upon the gasket 64 of the present invention. Now, in FIG. 10 it is noted that the gasket 64 is shown in its fully compressed position. In this regard, the ears 65 and 66 are fully deflected with the associated tips thereof contacting and spreading as illustrated in FIG. 10. Parts of even the cylindrical shaped part of the sealing gasket are urged into contact with the plate 18. The sealing lip 82, of course, also makes direct contact with the plate 18.

The base frame 14 also has means defining a channel 55 for receiving a securing bolt 56. The channel 55 is preferably threaded to receive the bolt 56. There are actually a plurality of these securing bolts or screws that are employed for securing the retainer over the glazing plates. The securing bolt 56 in FIG. 10 has associated therewith a cushion member 25. The securing bolt 56 actually passes through the glazing cushioning member 25, forming a cushioning for the edges of the glazing plates to prevent damage thereto, as well as to facilitate positioning thereof.

In the embodiment of the invention illustrated in FIG. 11, as indicated previously, there is basically three point contact to the glazing. This is provided by the sealing lip 82 and the oppositely disposed ear tips 65A and 66A. This particular construction with the use of a substantially open and somewhat oval shaped overall gasket configuration provides improved weather and air tightness. There are three surfaces of contact. Furthermore, there is a reactionary mechanical action that occurs when the gasket is compressed so as to enhance tightness of the gasket between the elements that are being compressed against the gasket. In this regard, once the tips 65B and 66B are compressed against the wall 62, further compression at 82 as indicated by the arrow A causes a hinging action at the base of the ears 65 and 66. This causes movement of the tips 65A and 66A in the direction of arrows B as noted in FIG. 11. This mechanical type action assists in providing enhanced tightness regarding the sealing provided by the gasket. In essence, the contact at the center of the gasket at its top causes a reactionary force at the ears 65 and 66.

Figure 13:
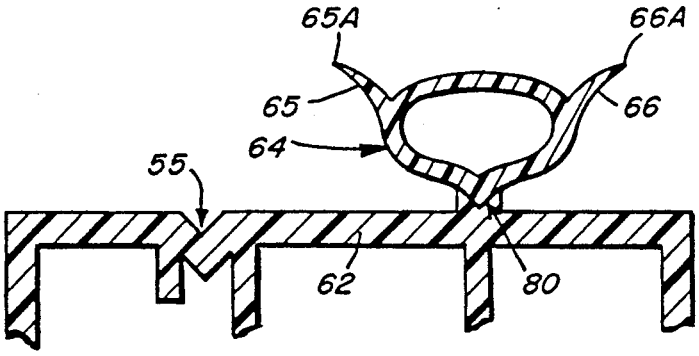
FIG. 13 is a cross-sectional view of an alternate embodiment of a gasket in accordance with the present invention.

Reference is also now made herein to FIG. 13 which is a fragmentary enlarged view of a portion of the curb frame illustrating the gasket of the present invention. In FIG. 13 like reference characters are used to identify like parts as previously described in connection with FIG. 11. FIG. 13 differs from FIG. 11 primarily with respect to the fact that the ears 65 and 66 do not have any lower respective tips 65B and 66B. Furthermore, the sealing lip 82 is smoothed over in the embodiment of FIG. 13. However, in FIG. 13 it is noted that there is still essentially three point contact regarding this gasket, particularly at the top side of the gasket.

Thus, in accordance with the present invention, there has now been described various embodiments thereof, further illustrating the universal use of the gasket construction. The multi sealing point gasket construction enables one to now use a single form of base frame, wherein the gasket can be employed either for sealing with an overlying frame or with a glazing plate or dome. In this connection, as previously discussed, in the application of FIG. 2 the gasket of the invention is preferably in a partially compressed position while in the embodiment of FIG. 10 is in a substantially fully compressed position.

Figure 14:
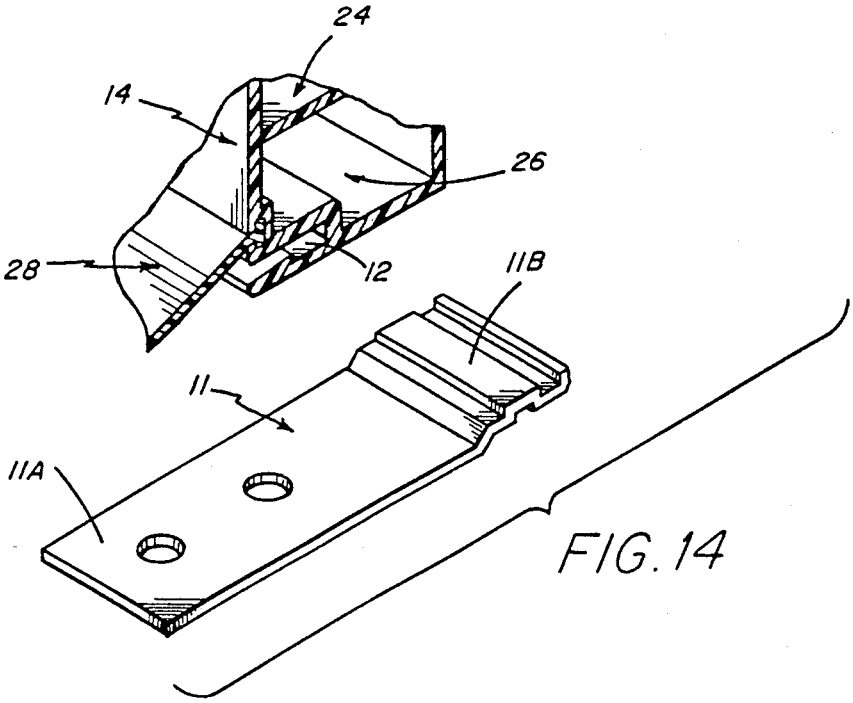
FIG. 14 is a fragmentary perspective view illustrating the securing clip and a section of the curb frame.
Figure 15:
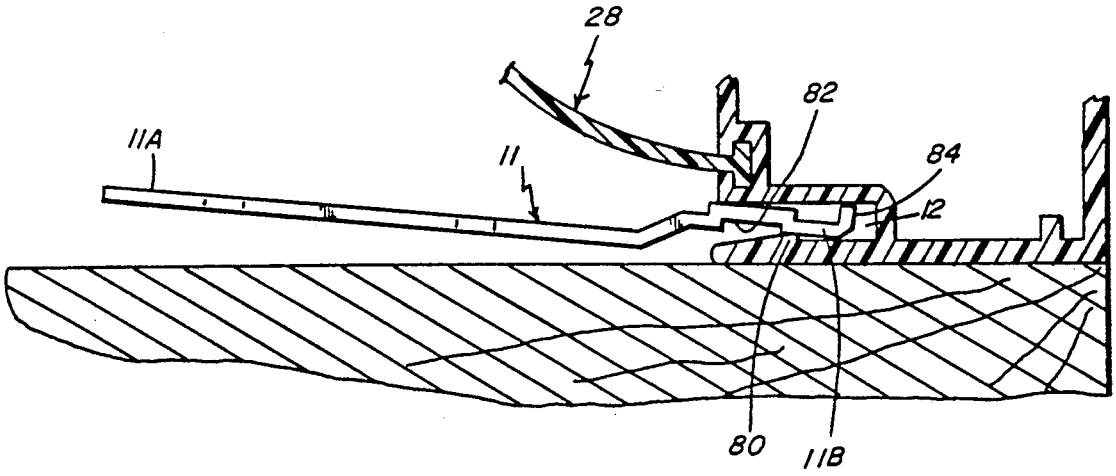
FIG. 15 is a fragmentary cross-sectional view of the curb frame at a securing clip and illustrating the position of the securing clip as it is partially inserted into the accommodating curb frame channel.

Reference is now made to FIGS. 14 and 15 herein for further details of the securing clip as constructed in accordance with the present invention. In this regard, FIG. 14 is a fragmentary perspective and exploded view illustrating a section of the curb frame and the securing clip. FIG. 15 is a fragmentary cross-sectional view illustrating the securing clip partially inserted into the channel or recess in the curb frame, which is adapted to receive the securing clip. It is noted in the view of FIG. 15 that the flexible sealing flange has been lifted so as to enable insertion of the securing clip 11. FIG. 15 has been shown to illustrate the manner in which the securing clip is inserted by tilting and then once it is in position the securing clip engages with a hook member in the recess.

As indicated previously, a plurality of securing clips 11, each having one end 11A for securing the clip to the roof construction, and another end 11B received by the base frame 14 at the recess 12, are disposed at different predetermined positions about the skylight. In this regard, refer to FIGS. 1 and 2, which show the positioning of the securing clip. As illustrated in FIG. 2, the securing clip at its end 11A is substantially flat and preferably has two holes for receiving roofing nails. In this regard, note the roofing nails 71 in FIG. 2. The opposite end 11B of the securing clip 11 has a stepped construction to enable the clip to interlock in the recess 12 and the base frame 14.

FIGS. 14 and 15 show further details of the securing clip, particularly at the end 11B. As indicated previously, there is a stepped construction defining a channel 82 and, furthermore, having an end wall 84 that is adapted to engage at the very bottom end of the recess 12. In this regard, FIG. 2 shows the clip fully in position and nailed down while FIG. 15 shows the securing clip partially inserted with the end wall 84 not yet fully into position and with the securing clip not yet interlocked with the recess in the curb frame.

For the purpose of interlocking of the securing clip, the recess 12 is provided with a hook segment 80 in which the entrance to the recess 12 is essentially ramped to define this hook segment. In FIG. 15, the securing clip is shown partially inserted with the channel 82 not yet engaged with the hook segment 80. As the securing clip is moved fully into the recess 12, then the securing clip may be moved downwardly at its end 11A so that the channel 82 engages at one side thereof with the hook member 80 as clearly illustrated in, for example, FIG. 2. As long as the end 11A of the securing clip 11 is not tilted upwardly, the securing clip at end 11B is maintained interlocked with the recess 12. Once the roofing nails 71 are secured through the end 11A of the securing clip 11 then there is a complete positive interlocking between the securing clip and the curb frame.

In connection with the installation of the securing clips, it is noted in FIG. 15 that the flexible flange 28 may be lifted so as to provide sufficient room for insertion of the securing clips. The securing clip is inserted at a slightly tilted angle, such as illustrated in FIG. 15, but then is rotated once it is fully engaged and fully in the recess 12, to a substantially horizontal position, such as the position illustrated in FIG. 2.

Having now described a limited number of embodiments of the present invention, it should now become apparent to those skilled in the art that numerous other embodiments and modifications are contemplated as falling within the scope of the present invention, as defined by the appended claims. In the embodiments described herein, such as in FIG. 2 of the drawings, it is noted that the gasket 64 is coextruded with the base of the curb frame. In an alternate embodiment of the invention, this gasket could also be coextruded and integral with the overlying support frame of the curb frame.

What is claimed is:

1. A skylight construction for an opening in a building comprising: a frame extending about the opening including means for securing said frame about the opening, translucent or transparent glazing means covering the opening and extending at edges to overlie said frame, means for retaining said glazing means on said frame, said means for retaining including a retainer and associated securing fastener, and a glazing cushioning member disposed between said retainer and said frame and including a cushioning piece supported adjacent said glazing means, said glazing cushioning member having means defining a passage therethrough for receiving and guiding said securing fastener.

2. A skylight construction for an opening in a building comprising: a frame extending about the opening and including means for securing said frame about the opening, translucent or transparent glazing means covering the opening and extending at edges to overlie the frame means, means for retaining said glazing means on said frame, said frame comprising a base frame and a support frame overlying the base frame, both said base frame and said support frame constructed of a rigid plastic material, said base and support frames having associated therewith at least one flexible gasket adapted to be positioned therebetween, said retaining means and said base frame each having an interlocking channel, and a foldable header gasket having opposite ends, one end being received by said interlocking channel of said retaining means, the other end being received by said interlocking channel of said base frame.

3. A skylight construction as set forth in claim 2, further including a gasket extending from said support frame and disposed between said support frame and said glazing means.

4. A skylight construction for an opening in a building comprising: a frame extending about the opening and including means for securing said frame about the opening, translucent or transparent glazing means covering the opening and extending at edges to overlie said frame, means for retaining said glazing means on said frame, said frame comprising a base frame and a support frame overlying the base frame, both said base frame and said support frame constructed of a rigid plastic material, said base and support frames having associated therewith at least one flexible gasket adapted to be positioned therebetween, said at least one flexible gasket having multiple contact sealing locations to form multiple seal areas extending along a line from inside to outside of said frame.

5. A skylight construction as set forth in claim 4, further including a gasket extending from said support frame and disposed between said support frame and said glazing means.

6. A skylight construction for an opening in a building comprising: a frame extending about the opening and including means for securing said frame about the opening, translucent or transparent glazing means covering the opening and extending at edges to overlie said frame, means for retaining said glazing means on said frame, said frame comprising a base frame, said means for retaining comprising a retainer, and a flexible gasket integral and coextruded with the said frame, said frame being constructed of rigid plastic material and said coextruded flexible gasket being constructed of a flexible plastic material, and said flexible gasket having multiple and separate contact sealing locations to form multiple seal areas.

7. A skylight construction as set forth in claim 6, wherein said flexible gasket is hollow and of generally tubular construction.

8. A skylight construction as set forth in claim 6, wherein said flexible gasket has at inner and outer sides thereof oppositely disposed sealing ears.

9. A skylight construction for an opening in a building comprising: a frame extending about the opening and including means for securing said frame about the opening, translucent or transparent glazing means covering the opening and extending at edges to overlie the frame, means for retaining said glazing means on the frame, said means for retaining including a retainer and associated securing fastener and a cushioning member disposed between said retainer and said frame and including a cushioning piece supported adjacent said glazing means, said retainer having a leg for positioning on top of the glazing means, and means for securing said cushioning member from said retainer leg so as to dispose said cushioning member laterally adjacent and in facing relationship to the peripheral edge of said glazing means.

10. A skylight construction as set forth in claim 9 wherein said means for securing includes means for snap fitting the cushioning member with the retainer leg.

11. A skylight construction as set forth in claim 8 wherein said cushioning members includes a body for supporting said cushioning piece, said body being of a rigid plastic material and said cushioning piece being of a more resilient plastic material in comparison to the material of the body.

* * * * *